US006460758B1

(12) United States Patent
Fenton et al.

(10) Patent No.: US 6,460,758 B1
(45) Date of Patent: Oct. 8, 2002

(54) TRAYS

(75) Inventors: Jason M. Fenton, Snodland; Michael C. Chapman, East Malling; William E. Burr, Aylesford, all of (GB)

(73) Assignee: SCA Packaging Limited, Kent (GB)

( * ) Notice: Subject to any disclaimer, the term of this patent is extended or adjusted under 35 U.S.C. 154(b) by 0 days.

(21) Appl. No.: 09/623,123

(22) PCT Filed: Feb. 24, 1999

(86) PCT No.: PCT/GB99/00558

§ 371 (c)(1),
(2), (4) Date: Nov. 3, 2000

(87) PCT Pub. No.: WO99/43560

PCT Pub. Date: Sep. 2, 1999

(30) Foreign Application Priority Data

Feb. 25, 1998 (GB) ..... 9804004

(51) Int. Cl.[7] ..... B65D 21/032

(52) U.S. Cl. ..... 229/174; 229/182; 229/915; 229/918; 206/509

(58) Field of Search ..... 229/174, 182, 229/915, 918, 919; 206/509, 511

(56) References Cited

U.S. PATENT DOCUMENTS

| | | | | |
|---|---|---|---|---|
| 3,946,934 A | | 3/1976 | Chaffers | |
| 4,304,353 A | * | 12/1981 | Stollberg | 206/509 |
| 4,770,339 A | * | 9/1988 | Weimer | 206/509 |
| 4,923,113 A | | 5/1990 | Guijarro | |
| 5,361,976 A | | 11/1994 | Bloomfield | |
| 5,649,663 A | * | 7/1997 | Pestow, Jr. | 229/915 |
| 5,860,590 A | | 1/1999 | Blomfield et al. | |

FOREIGN PATENT DOCUMENTS

| | | |
|---|---|---|
| AT | 393 485 B | 4/1991 |
| AU | 61361/90 | 3/1991 |
| AU | 13040/92 | 11/1992 |
| BE | 905 034 | 11/1986 |
| DE | 35 30 350 C2 | 8/1986 |
| DE | 35 40 005 C2 | 1/1987 |
| DE | 41 02 166 A1 | 7/1992 |
| EP | 0 326 451 A1 | 8/1989 |
| ES | 273162 | 6/1983 |
| ES | 284792 | 2/1985 |
| ES | 284979 | 2/1985 |
| ES | 285668 | 3/1985 |
| ES | 284792 | 7/1985 |

(List continued on next page.)

*Primary Examiner*—Gary E. Elkins
(74) *Attorney, Agent, or Firm*—Alix, Yale & Ristas, LLP

(57) ABSTRACT

A corrugated board tray has stacking lugs extending from double thickness side walls. The stacking lug is formed from an integral upward extension of only the outer one of the side wall panels. The lug is folded inwardly and secured to the inside of the side wall. Corresponding slots are formed at the junction of the side wall and the base to receive the stacking lugs of a lower tray. Half-size trays may include stacking lugs and slots formed in the end walls.

5 Claims, 7 Drawing Sheets

FOREIGN PATENT DOCUMENTS

| | | | |
|---|---|---|---|
| ES | 287875 | | 7/1985 |
| ES | 287952 | | 7/1985 |
| ES | 288182 | | 7/1985 |
| ES | 289749 | | 10/1985 |
| ES | 8801704 | | 5/1988 |
| ES | 8803565 | U | 12/1988 |
| ES | 8901825 | U | 6/1989 |
| ES | 9002306 | U | 7/1990 |
| ES | 9103106 | U | 10/1991 |
| ES | 1 018 839 | | 2/1992 |
| ES | 1 019 052 | | 2/1992 |
| FR | 1.427.904 | | 4/1966 |
| FR | 2 306 888 | | 11/1976 |
| FR | 2 584 375 | | 1/1987 |
| FR | 2 615 822 | | 12/1988 |
| FR | 2 577 522 | | 4/1990 |
| FR | 2 584 375 | | 4/1990 |
| FR | 2 682 936 | | 7/1995 |
| GB | 962191 | | 7/1964 |
| GB | 1163415 | | 12/1969 |
| GB | 1589 990 | | 5/1981 |
| GB | 2 086 352 | A | 5/1982 |
| GB | 2 173 480 | A | 10/1986 |
| GB | 2 188 026 | A | 9/1987 |
| GB | 2 232 403 | A | 12/1990 |
| GB | 2 232 403 | B | 12/1990 |
| GB | 2 279 331 | A | 1/1995 |
| GB | 2 279 331 | B | 1/1995 |
| IT | 05113/86 | | 1/1986 |
| IT | 1202279 | | 2/1989 |
| LI | 669 770 | A5 | 4/1989 |
| SE | 469 169 | | 5/1993 |
| WO | WO96/32329 | | 10/1996 |

* cited by examiner

TRAYS

BACKGROUND OF THE INVENTION

1. Field of the Invention

This invention relates to trays made of cardboard, corrugated board or similar lightweight foldable sheet material.

2. Description of the Related Art

Such trays are often used for storing and transporting fresh foodstuffs such as fruit and vegetables and are then required to be stackable one upon another in stable fashion. To achieve stable stacking, i.e. reliable location of each tray against lateral movement relative to the one below it in a stack, it is known to form the tray with integral stacking lugs upstanding from the tops of its side walls, for engagement in recesses at the edge of the base of a similar tray stacked on top of it. Such a stacking lug can be a simple, single thickness, upward extension of a wall panel, but a lug of this kind is likely to bend and/or fray quite quickly during use and is therefore not satisfactory. A substantial improvement is provided by forming a stacking lug as a folded over, double thickness, integral upward extension of the respective panels of a folded over, double thickness, side wall, as in GB-A-2279331. With this arrangement however, in order to provide the necessary sheet material between the wall panels to form the stacking lug, a comparatively wide strip of sheet material has to be provided extending along the top of the wall, integrally interconnecting the wall panels. Only a small part of the length of this strip is used to create the stacking lug, and thus a substantial wastage of sheet material occurs.

SUMMARY OF THE INVENTION

According to the present invention there is provided a tray made of cardboard, corrugated board or similar lightweight foldable sheet material, having a base, a side wall, and a stacking lug extending upwardly above the top of said side wall, the side wall being of double thickness formed of hingedly interconnected inner and outer side wall panels, the outer one connected to the base, folded over face to face, and the stacking lug comprising an integral upward extension of only the outer one of said side wall panels, folded over inwardly to be of double thickness and held to the inside of the said wall.

As such a stacking lug is integral with only the outer side wall panel it is no longer necessary to provide sufficient sheet material between the panels to create it. Instead, substantially all of the material to form the lug can be taken from the inner side wall panel by releasing the lug material therefrom.

The stacking lug may be held to the inside of its associated side wall in any convenient fashion, such as by gluing or stapling. In a preferred form of the invention however the stacking lug is held to the wall by having part thereof trapped between the said inner and outer wall panels. Again preferably, the lug may be formed with two opposite laterally protruding wing portions which are trapped as aforesaid.

BRIEF DESCRIPTION OF THE DRAWINGS

Some embodiments of the invention will now be described by way of example and with reference to the accompanying drawings in which.

DESCRIPTION OF THE PREFERRED EMBODIMENTS

Figure 1:
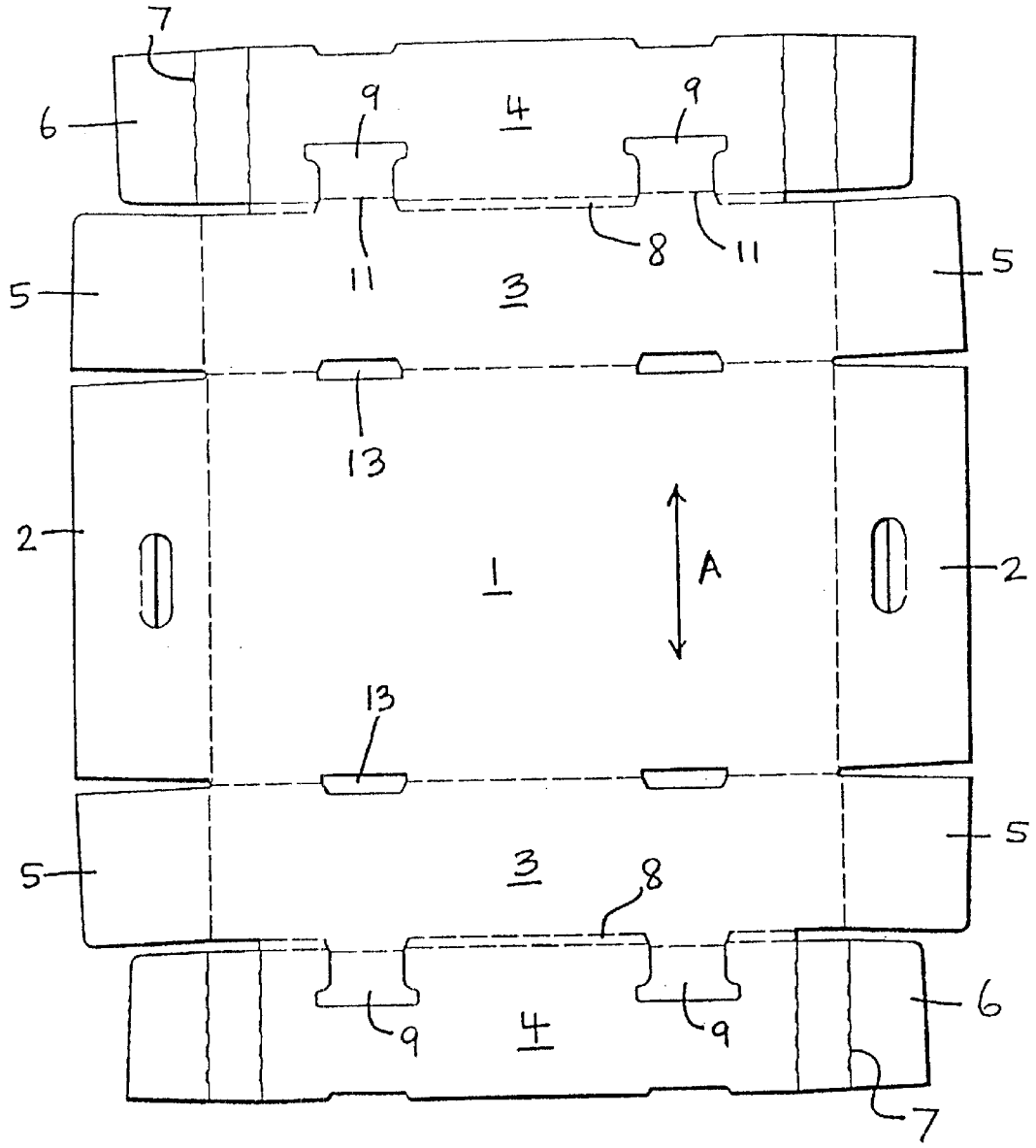
FIG. 1 is a plan view of a blank for making a tray according to a first embodiment.
Figure 3:
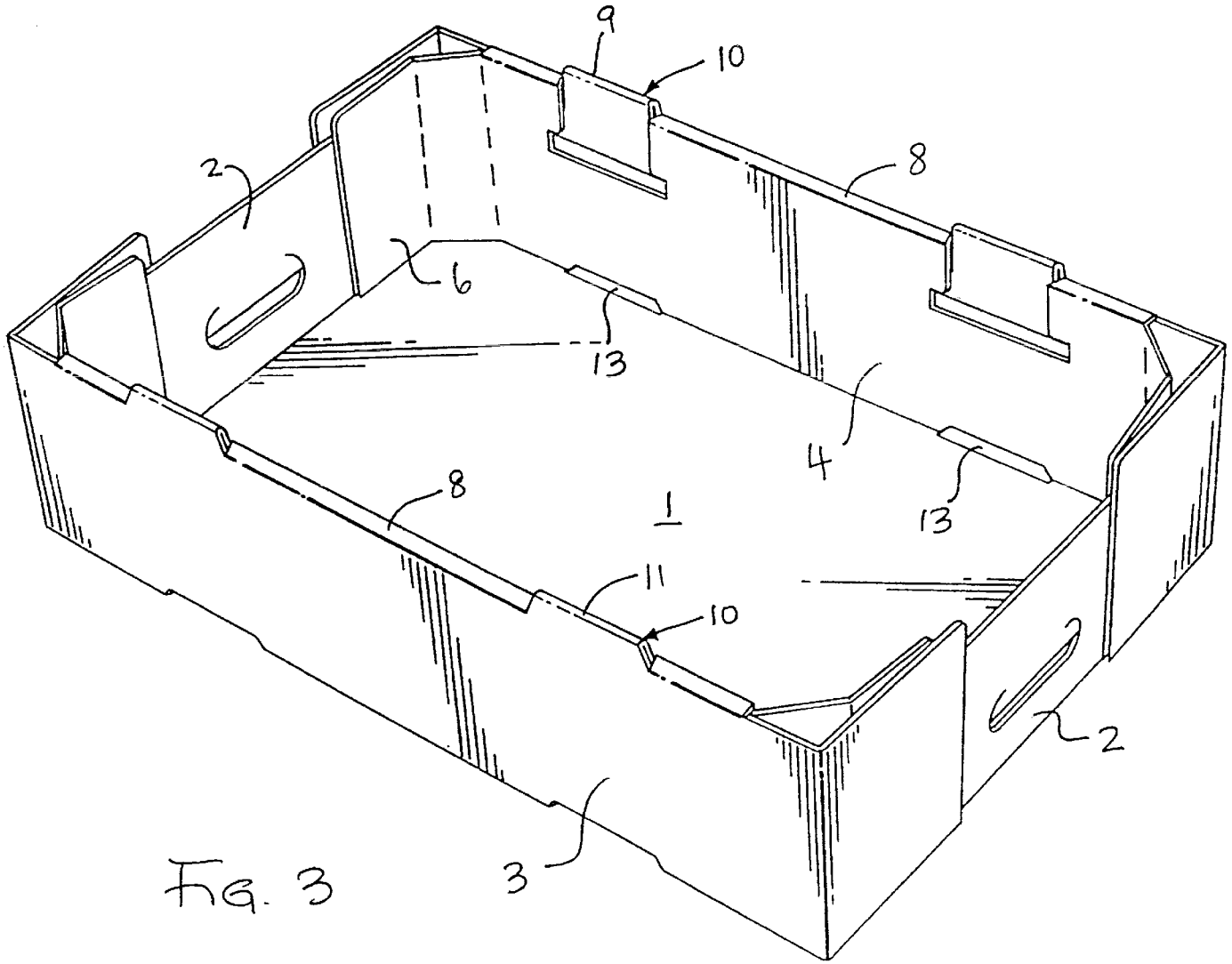
FIG. 3 is a perspective view of the tray formed from the blank of FIG. 1.

Referring first to FIGS. 1 and 3, a blank made of double faced single flute board has its flutes running in the direction of the arrow A in the Figure. The blank comprises a base panel 1, end wall panels 2 and side wall panels 3 and 4. The latter panels are arranged to form side walls of double thickness by folding up the panel 3 at right angles to the base panel and folding in the panel 4 through 180° relative to the panel 3, about double fold lines 8, to form a double thickness side wall whose outer layer is formed by the panel 3 and whose inner layer is formed by the panel 4.

End flaps 5 are provided on each of the wall panels 3, which are glued to the outside of the end walls 2 in the erected tray. Further end flaps 6 containing fold lines 7 are provided on the wall panels 4 to provide corner reinforcements in the erected tray, again glued to the end walls 2, as seen in FIG. 3.

The configuration of the side edges of the flaps 5 and 6 is such that the double thickness side walls are slightly inwardly inclined in the erected tray.

Figure 2:
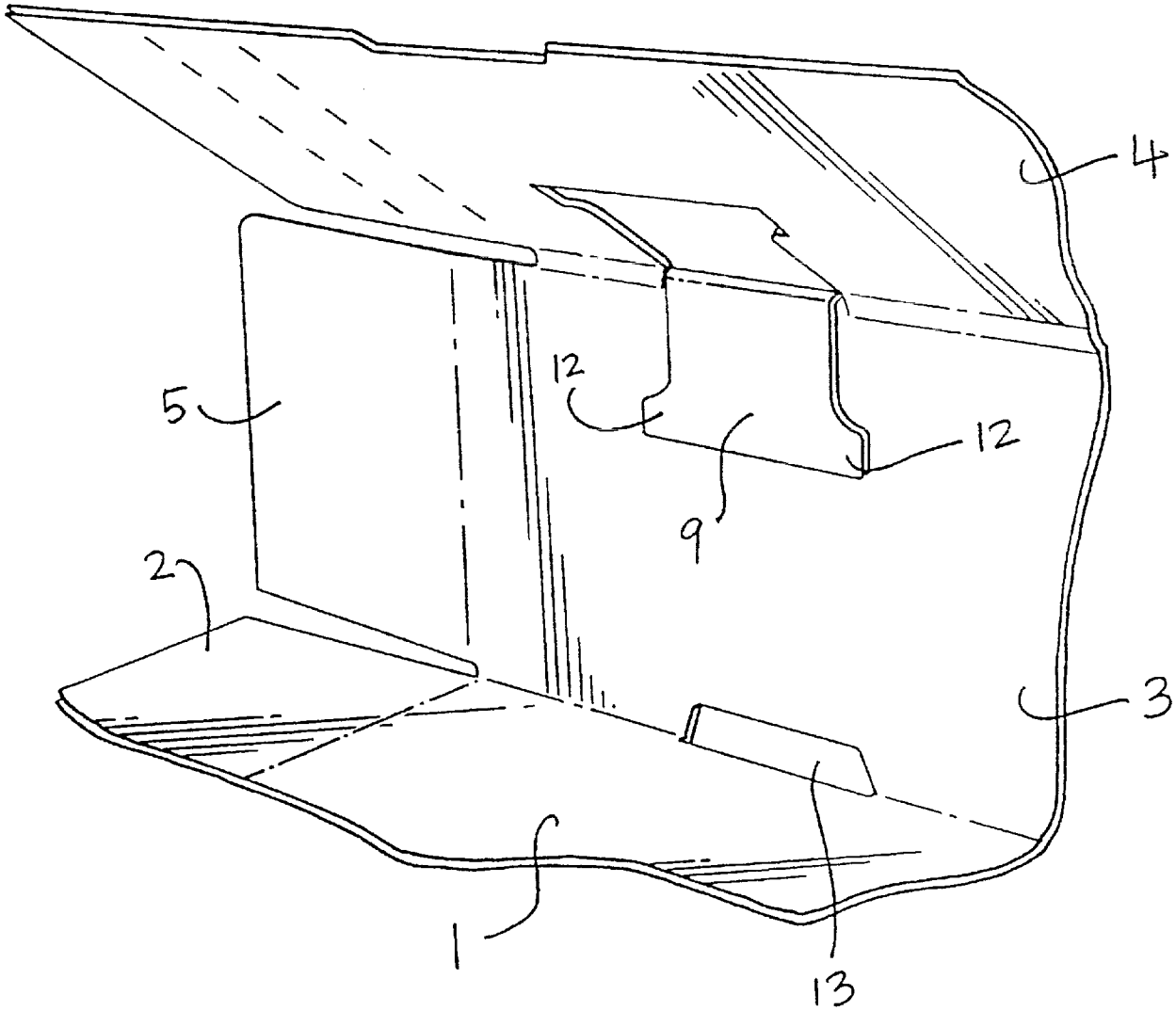
FIG. 2 is a perspective view to illustrate a stage in the erection of the blank of FIG. 1.

Areas of board 9 which are to be used to create stacking lugs 10 are released from each of the wall panels 4, by suitably shaped cuts. Referring now particularly to FIG. 2, after the wall panels 3 have been erected relative to the base panel, the parts 9 released from the wall panels 4 are next folded down through 180° about single fold lines 11, which fold lines are located at the crests of the stacking lugs 10 in the erected tray, as seen in FIG. 3. The wall panels 4 are then folded down so that they trap lateral wing portions 12 of the stacking lug parts between themselves and the wall panels 3, thus holding the stacking lug parts to the wall, again as seen in FIG. 3. Slots 13 are formed at the sides of the base panel 1, to receive the stacking lugs when two trays are stacked.

Figure 4:
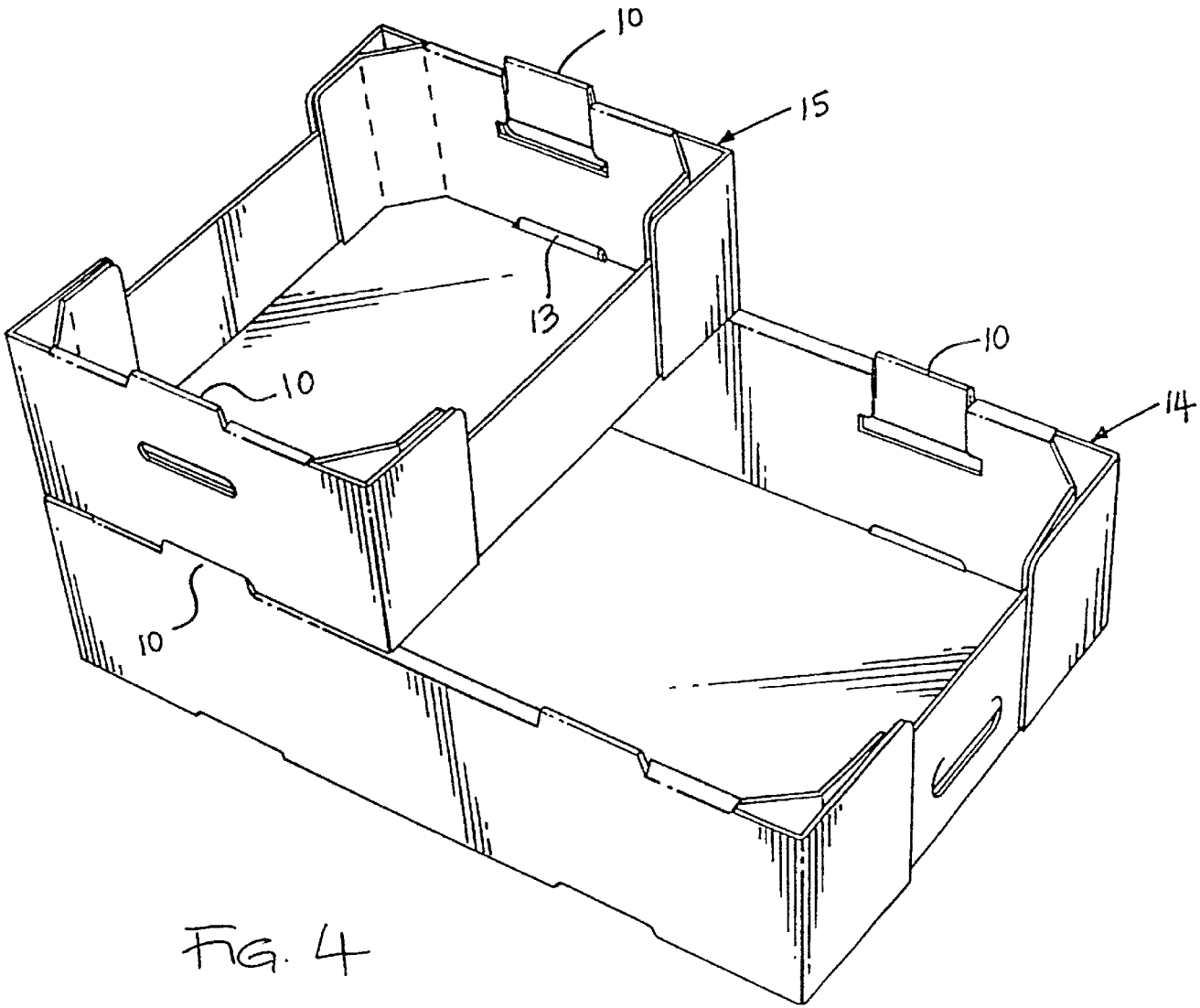
FIG. 4 is a perspective view of the same tray, with another tray according to the invention stacked on it.

Referring now to FIG. 4, this shows a tray 14 of the kind illustrated in FIG. 3, together with a further tray 15 according to the invention but of half the size of tray 14. The tray 15 is formed with stacking lugs 10 in its end walls and complementary recesses 13 for receiving the same at the ends of its base panel. As a result, one or two of the smaller trays 15 can be stacked transversely on the larger one, and further large or small trays can of course be stacked on those.

Figure 5:
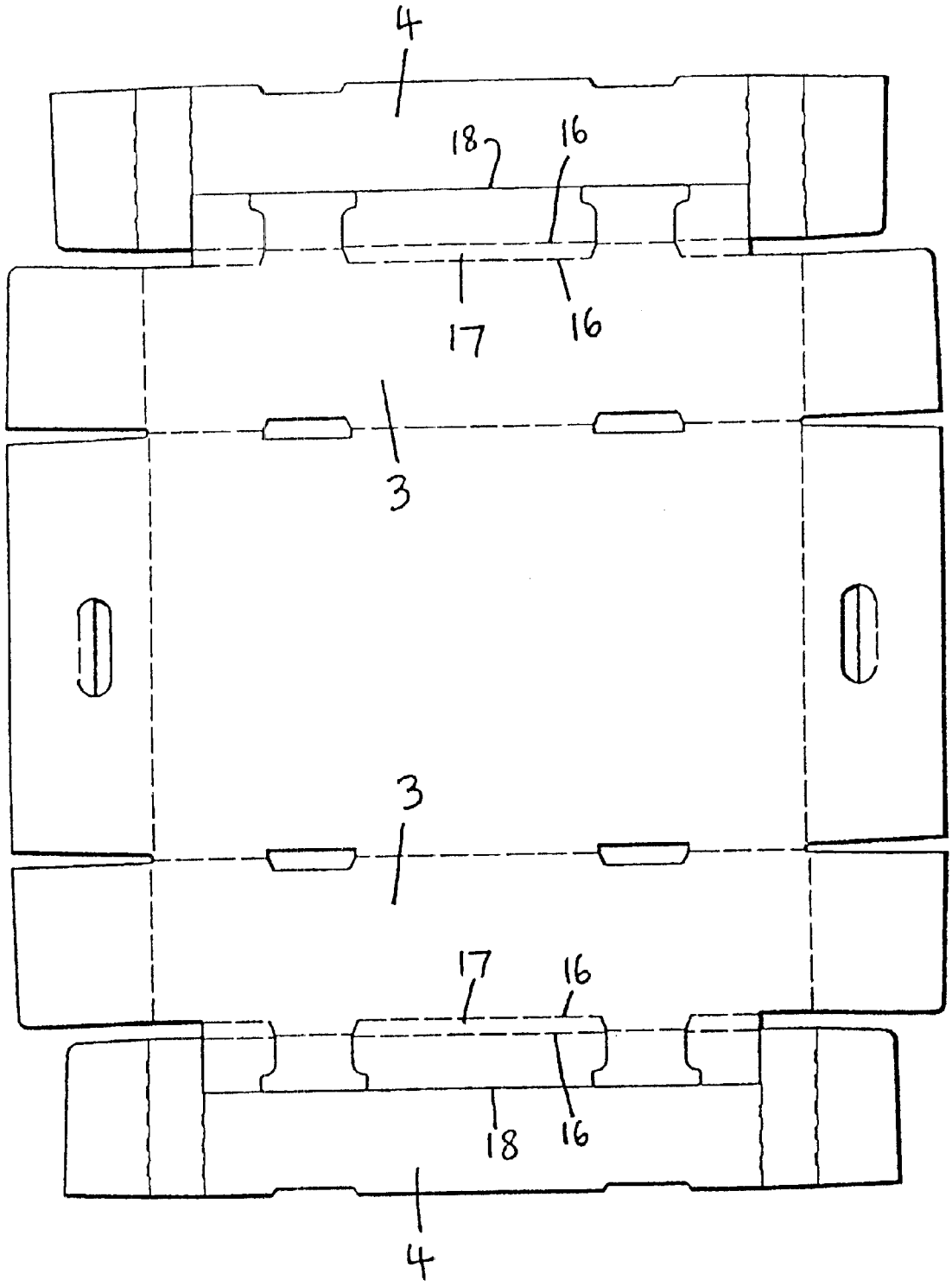
FIG. 5 is a plan view of a blank for making a tray according to a second embodiment.
Figure 6:
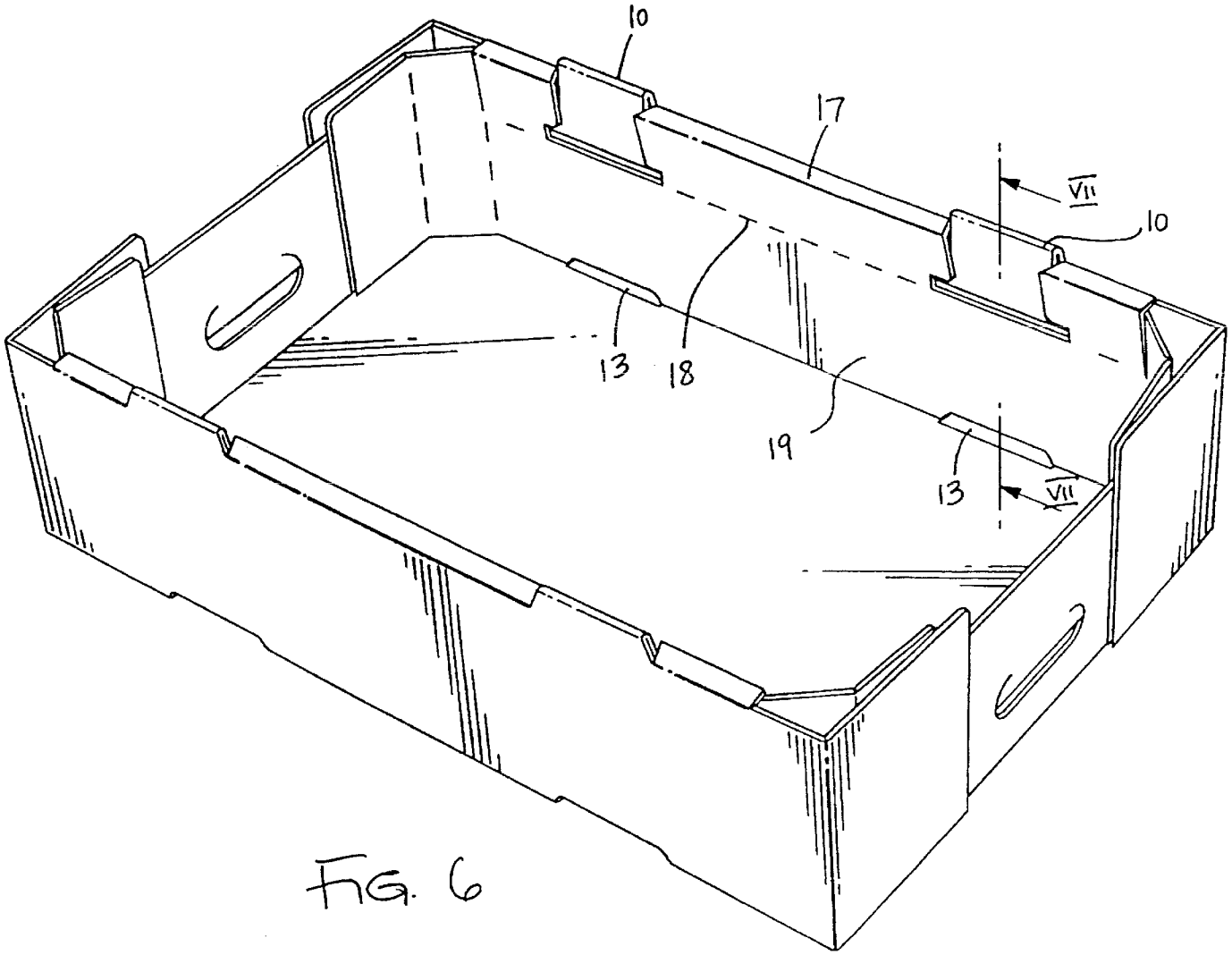
FIG. 6 is a perspective view of a tray formed from the blank of FIG. 5.
Figure 7:
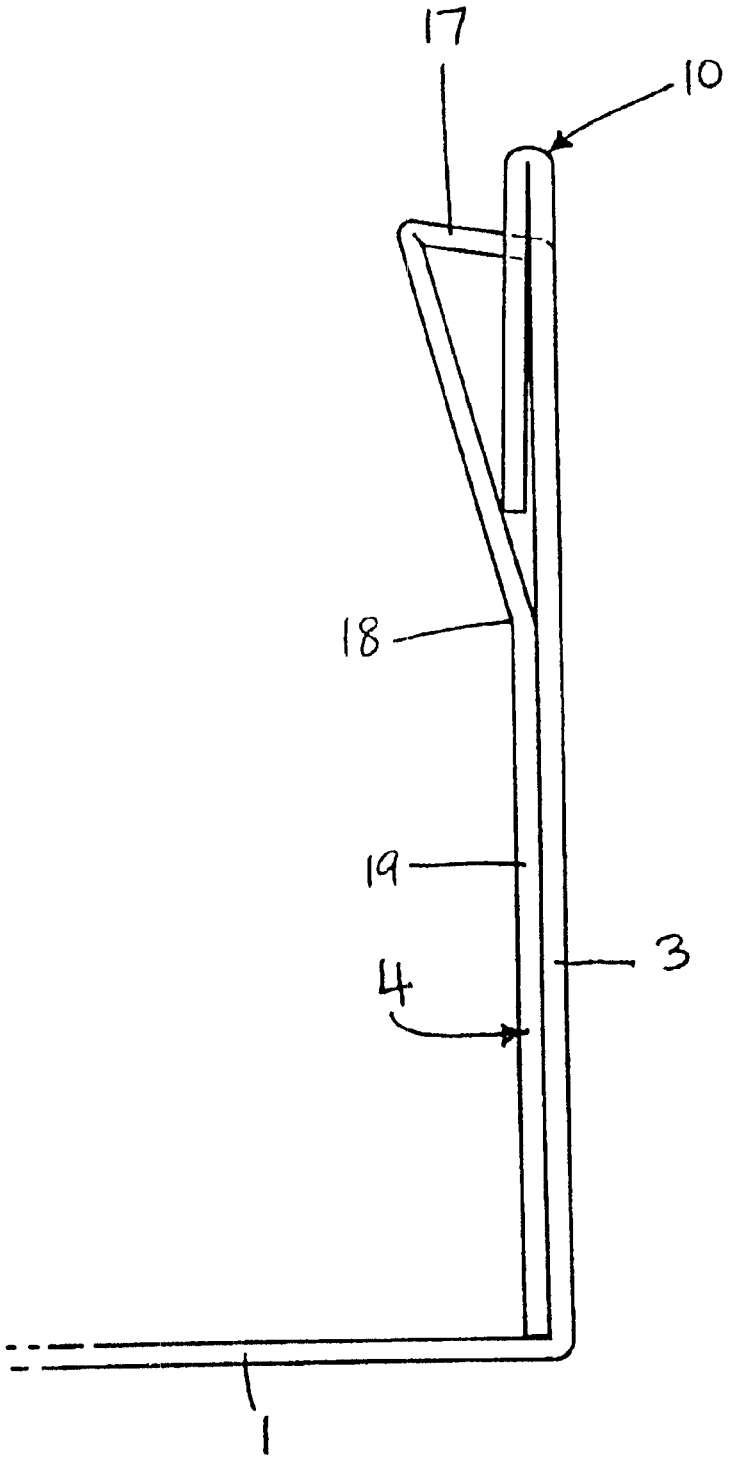
FIG. 7 is a cross-section on line VII—VII of FIG. 6.

FIGS. 5 to 7 show a modified embodiment in which a more widely spaced pair of fold lines 16 is provided between the wall panels 3 and 4 so as to form a shelf 17 along the top of the double wall, to provide additional underneath support for a tray or trays stacked above. An additional fold line 18 is provided in the wall panel 4 so that the lower part 19 of this panel can be glued to the wall panel 3, as shown in FIG. 7. The wings 12 of the stacking lug parts 19 are trapped between the panels 3 and 4, as in the previous embodiment.

Although this specification refers throughout to trays, this does not mean that the invention is only applicable to open topped container whose side walls are low relative to their horizontal dimensions. Indeed the invention is equally applicable to open topped containers with side walls of any height, even ones whose side walls are taller than they are long.

What is claimed is:

1. A tray made of cardboard, corrugated board or similar lightweight foldable sheet material, having a base, a side wall, and at least one stacking lug extending upwardly above the top of said side wall, the side wall being of double thickness formed of hingedly interconnected inner and outer side wall panels, the outer side wall panel connected to the base being folded over in adjacent face to face relationship, and the stacking lug comprising an integral upward extension of only the outer side wall panel, folded over inwardly about only a single fold line to be of double thickness and held to the inside of the side wall.

2. A tray as claimed in claim 1, wherein substantially all of the sheet material forming the said stacking lug is provided by being released from the inner side wall panel.

3. A tray as claimed in claim 2, wherein the said stacking lug is held to the side wall by having part of the said stacking lug trapped between the said inner and outer wall panels.

4. A tray as claimed in claim 3, wherein the said stacking lug is formed with two opposite laterally protruding wing portions which are trapped between said inner and outer side wall panels.

5. A tray as claimed in claim 1, wherein said tray comprises at least one slot at the junction of said side wall and said base, said notch being complementary to said at least one stacking lug.

* * * * *